US005576160A

United States Patent [19]

Goan et al.

[11] Patent Number: 5,576,160

[45] Date of Patent: Nov. 19, 1996

[54] COMPOSITE OF SILVER HALIDE PHOTOGRAPHIC LIGHT-SENSITIVE MATERIAL AND RADIATION FLUORESCENT SCREEN

[75] Inventors: Kazuyoshi Goan; Haruhiko Sakuma; Takuji Hasegawa; Kazuhiro Iwasaki, all of Hino, Japan

[73] Assignee: Konica Corporation, Tokyo, Japan

[21] Appl. No.: 498,777

[22] Filed: Jul. 5, 1995

[30] Foreign Application Priority Data

Jul. 11, 1994 [JP] Japan ..... 6-158738

[51] Int. Cl.[6] ..... G03C 5/17

[52] U.S. Cl. ..... 430/509; 430/139; 430/502; 430/966

[58] Field of Search ..... 430/363, 502, 430/509, 517, 518, 966, 139

[56] References Cited

U.S. PATENT DOCUMENTS

| | | | |
|---|---|---|---|
| 4,130,428 | 12/1978 | Van Doorselear | 430/139 |
| 4,425,425 | 1/1984 | Abbott et al. | 430/502 |
| 4,425,426 | 1/1984 | Abbott et al. | 430/502 |
| 4,695,531 | 9/1987 | Delfino et al. | 430/518 |
| 4,707,435 | 11/1987 | Lyons et al. | 430/506 |
| 4,710,637 | 12/1987 | Luckey et al. | 250/486.1 |
| 4,803,150 | 2/1989 | Dickerson et al. | 430/502 |
| 4,900,652 | 2/1990 | Dickerson et al. | 430/502 |
| 4,994,355 | 2/1991 | Dickerson et al. | 430/509 |
| 4,997,750 | 3/1991 | Dickerson et al. | 430/509 |

FOREIGN PATENT DOCUMENTS

| | | |
|---|---|---|
| 0384753 | 8/1990 | European Pat. Off. . |
| 0577027A1 | 1/1994 | European Pat. Off. . |

*Primary Examiner*—Hoa Van Le

*Attorney, Agent, or Firm*—Frishauf, Holtz, Goodman, Langer & Chick, P.C.

[57] ABSTRACT

A composite for radiography is disclosed which essentially consists of a) a silver halide photographic light-sensitive material comprising a transparent support and at least one light-sensitive silver halide emulsion layer provided on each side of the support, b) fluorescent screen A having a 80 kVp X-ray energy absorption of 40% or more and c) fluorescent screen B having a 80 kVp X-ray energy absorption of 50% or more and the absorption more than fluorescent screen A, the material being sandwiched between the screens A and B in such a manner that emulsion layer A is in close contact with screen A and emulsion layer B is in close contact with screen B, wherein the slope of the straight portion in the characteristic curve of emulsion layer A is less than that of emulsion layer B and emulsion layers A and B of the silver halide photographic light-sensitive material have sensitivity on an exposed side that an exposure necessary to give a density of the minimum density +0.5 is 0.027 to 0.040 lux·second.

10 Claims, 1 Drawing Sheet

COMPOSITE OF SILVER HALIDE PHOTOGRAPHIC LIGHT-SENSITIVE MATERIAL AND RADIATION FLUORESCENT SCREEN

FIELD OF THE INVENTION

The invention relates to a composite of a silver halide photographic light-sensitive material (hereinafter also referred to as a light-sensitive material) providing high image quality with fluorescent screens (hereinafter also referred to as screens) and particularly to a method of forming a radiation image having excellent medical diagnostic reliability by a composite of a light-sensitive material with fluorescent screens which has improved sharpness and graininess.

BACKGROUND OF THE INVENTION

X-ray photographs for medical use are obtained by exposing a light-sensitive material to a fluorescent light, emitted from a fluorescent substance in a fluorescent screen excited by absorbing X-ray radiation, and developing the material to form an image, which is then used for medical diagnosis. Therefore, light-sensitive materials giving high sharpness and excellent graininess are required in view of early detection of focuses and prevention of an erroneous medical diagnosis.

High sharpness and excellent graininess of light-sensitive materials are extremely important, since they have an influence on the diagnosis reliability and the amount of obtainable information. However, in a medical radiographic light-sensitive material having a light-sensitive silver halide emulsion layer on each side of a support sandwiched between two fluorescent screens, occurs on X-ray radiation so called, "crossover" phenomenon on each side of the support, in which light emitted from a florescent screen passes through emulsion layers and the support, and reaches the other emulsion layer on the side of the support opposite the emulsion layers, whereby the other emulsion layer is exposed. This phenomenon is a major cause for deterioration of image sharpness. Many methods has been proposed so far in order to reduce the crossover from both sides of the support and thereby improve image sharpness. For example, Japanese Patent O.P.I. Publication No. 61-132945/1986, U.S. Pat. No. 4,130,428 and British Patent No. 821,352 disclose a silver halide emulsion layer or other photographic layer comprising a dye. However, this method has the problem that the dye migrates to adjacent layers in coating or during storage, and for example, the dye migrates to an emulsion layer, resulting in lowered sensitivity.

Japanese Patent Publication No. 5-55014 discloses a method providing a non-light-sensitive layer between a light-sensitive silver halide emulsion layer and a support. For example, when the non-light-sensitive layer comprises silver halide grains adsorbed with a large amount of dyes using this method, crossover is reduced. However, this method has the problem that staining occurs.

In a medical light-sensitive material, rapid processing is strongly demanded, because the amount of a light-sensitive material increases due to an increase in diagnosis frequency and in diagnosis items and it is necessary to quickly inform patients of diagnosis results. The demand is especially strong in angiography and photographing during operations. In recent rapid processing the conventional material causes marked staining and therefore, is not suitable for practical use.

Radiographic images for medical use are obtained from a combination of a fluorescent screen and a light-sensitive material. Therefore, the image quality is influenced by the fluorescent screen, as well as the light-sensitive material itself.

In radiography, a combination of a fluorescent screen and a light-sensitive material is not particularly specified. For example in lumbar radiography, cranial angiography or enlargement radiography, in which high sensitivity is necessary, a combination of a fluorescent screen having high emission strength and a light-sensitive material having standard sensitivity or high sensitivity is usually used. For example in chest radiography, stomach radiography or bone radiography, in which image quality is important, a combination of a fluorescent screen having high sharpness and a light-sensitive material having standard sensitivity is usually used. A combination of a fluorescent screen having high sensitivity with a light-sensitive material having high sensitivity results in deterioration of image sharpness, and on the other hand, a combination of a fluorescent screen having low sensitivity with a light-sensitive material having low sensitivity results in deterioration of sensitivity.

Japanese Patent O.P.I. Publication No. 3-21898/1991 discloses a method of improving graininess by increasing a filling rate of a fluorescent substance in a fluorescent screen. Japanese Patent O.P.I. Publication No. 2-266344/1990 discloses a combination of an X-ray light-sensitive material having a silver halide emulsion layer different from each other on each side of a support and a fluorescent screen having a layer different from each other on each side of a support which reduces crossover, improves image sharpness and improves exposure latitude. As factors which influence image quality of medical radiography, graininess, sharpness and contrast of the image must be mentioned. In a combination of SR-G, a light-sensitive material having standard sensitivity with SRO-250, a standard fluorescent screen, (each produced by Konica Corporation), 50% or more of deterioration of graininess result from quantum mottle at a 110 kVp or more tube voltage of an X-ray generating tube which is a standard condition for chest radiography. This quantum mottle markedly lowers graininess or quality of the image. A combination with a light-sensitive material having high sensitivity further increases the quantum mottle, and further lowers image quality.

In order to improve the image quality of radiography, it is necessary to maintain or improve image sharpness, while reducing this quantum mottle. When image sharpness is improved by decreasing crossover of a light sensitive material for radiography, graininess corresponding to the improved sharpness deteriorates, and it does not follow that image quality is improved. In view of the above, the method described above, as disclosed in Japanese Patent O.P.I. Publication No. 3-21898/1991, is conducted which improves image sharpness and graininess by increasing the filling rate of a fluorescent substance in a fluorescent screen.

When a light sensitive material which markedly decreases crossover is used in combination with a fluorescent screen having a filling rate of 66% or less of a fluorescent substance, there occurs a phenomenon that graininess corresponding to the improved sharpness deteriorates. Therefore, image sharpness and graininess have been balanced in a silver halide photographic light-sensitive material for radiography having a crossover exceeding 20%. However, image quality of radiograph for medical use is not satisfactory, and further improvement has been requested.

SUMMARY OF THE INVENTION

The invention solves the above problems and provides a composite, for medical use of a silver halide photographic light-sensitive material with fluorescent screens, which has improved sharpness and graininess and excellent medical diagnostic reliability.

DETAILED DESCRIPTION OF THE INVENTION

Figure 1:
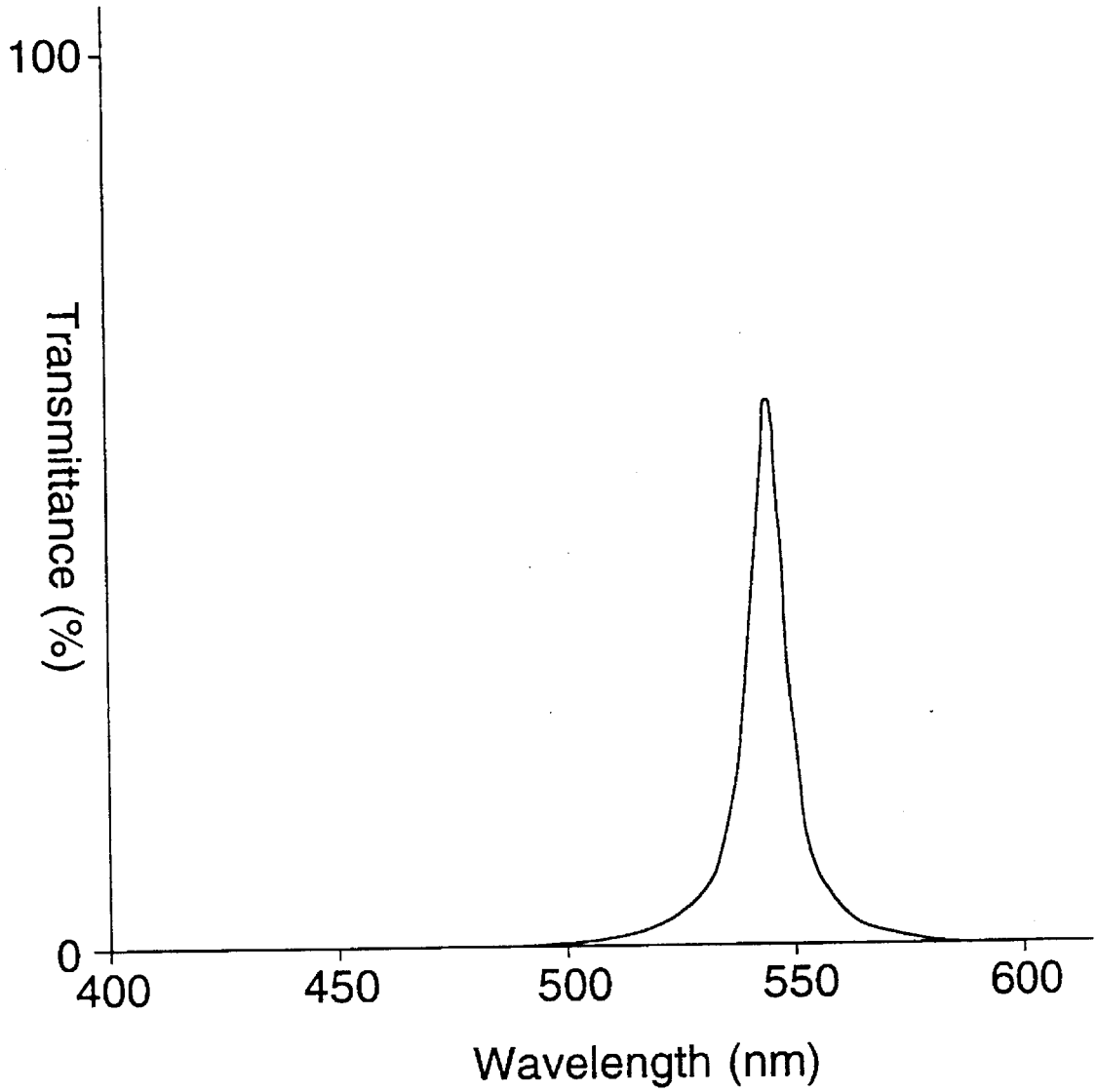
FIG. 1 shows a spectral curve of a green filter used in combination with a tungsten lamp for sensitivity measurement of a silver halide photographic light-sensitive material.

The above problems have been solved by the followings:

1) A composite for an X-ray imagewise exposure essentially consisting of:
   a) a silver halide photographic light-sensitive material comprising a transparent support and at least one light-sensitive silver halide emulsion layer provided on each side of the support,
   b) fluorescent screen A having an absorption of 40% or more of a 80 kVp X-ray energy and
   c) fluorescent screen B having a 80 kVp X-ray energy absorption of 50% or more and the absorption more than fluorescent screen A, the material being sandwiched between the screens A and B in such a manner that emulsion layer A is in close contact with screen A and emulsion layer B is in close contact with screen B, and screen A being positioned on the X-ray radiation source side, wherein the slope of the straight portion in the characteristic curve of emulsion layer A is less than that of emulsion layer B and emulsion layers A and B of the silver halide photographic light-sensitive material have sensitivity on an exposed side that, when the material is exposed to a monochromatic light having the same wavelength as a main emission peak wavelength of the screens and having a half band width of 15±5 nm and developed at 35° C. for 25 seconds with the following developer, an exposure necessary to give a density of the minimum density+0.5 is 0.027 to 0.040 lux·second,

| Developer | |
|---|---|
| Potassium hydroxide | 21 g |
| Potassium sulfite | 63 g |
| Boric acid | 10 g |
| Hydroquinone | 26 g |
| Triethylene glycol | 16 g |
| 5-methylbenzotriazole | 0.06 g |
| 1-phenyl-5-mercaptotetrazole | 0.01 g |
| Glacial acetic acid | 12 g |
| 1-phenyl-3-pyrazolidone | 1.2 g |
| Glutaraldehyde | 5 g |
| Potassium bromide | 4 g |

Water added to 1 liter, and pH adjusted to 10.0.

2) The composite for an X-ray imagewise exposure essentially consisting of the silver halide photographic light-sensitive material and the fluorescent screens of Item 1) above, wherein sensitivity of the emulsion layer A is higher than that of the emulsion layer B.

3) The composite for an X-ray imagewise exposure essentially consisting of the silver halide photographic light-sensitive material and the fluorescent screens of Item 1) or 2) above, wherein a layer reducing a light which emits from a fluorescent screen and arrives at the other emulsion layer of the support opposite the fluorescent screen through a protective layer, an emulsion layer and a support is provided between the support and the emulsion layer.

The invention will be detailed below.

Generally, silver halide grains are prepared as a silver halide emulsion comprising the grains and used.

The silver halide emulsion used in the light-sensitive material in the invention may contain any of silver iodobromide, silver iodochloride or silver iodochlorobromide, and preferably contain silver iodobromide, in view of high sensitivity. The silver halide grains may be in a cubic, octahedral or tetradecahedral form growing in all directions, in a spherical crystal form having many surfaces, in a twin crystal form having face defects or a mixture or complex form.

The grain form is preferably a tabular form having an aspect ratio (a diameter equivalent to a circle/thickness) of 3 or more, and more preferably, a tabular form having an aspect ratio of 5–8 and the diameter of 0.4 μm or more, preferably 0.6–2.0 μm. The halogen distribution inside the grains may be in a uniform or layered structure (core/shell type).

The silver halide emulsion in the invention can be prepared according to any of an acid, neutral or ammonia method, and a double-jet method is preferably used when a soluble silver salt and a soluble halide are reacted. As the double-jet method, so-called controlled double-jet method can be used which keeps constant pAg in the emulsion silver halide grains produce. The silver halide grains obtained according to this method have regular crystal form and almost uniform grain size.

The addition rate is disclosed in Japanese Patent O.P.I. Publication Nos. 54-48521/1979 and 58-49938/1983.

In preparing the silver halide emulsion in the invention fine silver iodide grains (hereinafter referred to as fine grains) may be supplied at the grain formation step. The size of the fine grains is preferably 0.3 μm or less in terms of a diameter equivalent to a circle, although it varies depending upon a host grain size or a halogen composition since it controls a supplying rate of an iodide ion. The size is more preferably 0.1 μm or less. In order to cover the host grains with the fine grains by recrystallizing, the diameter of the fine grains is preferably less than that of the host grains, and more preferably 1/10 or less of that of the host grains. The halide composition of the fine grains have a iodide content of 95 mol % or more. Preferably the fine grains are silver iodide grains.

After the silver halide growth in preparing the silver halide emulsion in the invention, soluble salts are removed according to an appropriate method and the resulting emulsion is adjusted to an optimal pAg suitable for chemical sensitization. In order to remove soluble salts from the emulsion, a noodle washing method or a flocculation precipitation method can be used which is disclosed in Research·Disclosure 17643. The preferable washing methods include a method that uses an aromatic hydrocarbon aldehyde resin containing a sulfo group described in Japanese Patent Publication No. 35-16086/1960 or a desalting method that uses polymer coagulation agents illustrated G-3 and G-8 described in Japanese Patent OPI. Publication No. 2-7037/1990. The silver halide emulsion in the invention comprises various hydrophilic colloids as binders for covering silver halide grains. The colloids include binders such as gelatin, synthetic polymers such as polyvinyl alcohol, colloid albumin, polysaccharides and cellulose derivatives.

The conventional sulfur, reduction or noble metal sensitization or a combination thereof may be used at chemical sensitization. The typical chemical sensitizers include sulfur sensitizers such as allyl thiocarbamide, thiourea, thioether and cystein, noble metal sensitizers such as potassium chloroaurate, aurous thiosulfate and potassium chloropalladate and reduction sensitizers such as stannic chloride, phenylhydrazine and reductone.

The silver halide emulsion in the invention may be spectrally sensitized with cyanine dyes or other dyes. The spectral sensitizers may be used singly or in combination. The combination is used for the purpose of supersensitization.

For the emulsion used in the silver halide photographic light-sensitive material of the invention, various additives for photographic use can be used in a step before or after physical ripening or chemical ripening. The conventional additives include various compounds described in (RD) Nos. 17643(December, 1978), 18716(November, 1979) and 108119(December, 1989) can be used. Locations where the compounds are described in these three (RD) are shown below:

| | RD-17643 | | | RD-308119 | |
|---|---|---|---|---|---|
| Additive | Page | Classification | RD-18716 Page | Page | Classification |
| Chemical Sensitizer | 23 | III | 648 upper right | 996 | III |
| Sensitizing Dye | 23 | IV | 648–649 | 996–8 | IV |
| Desensitizing Dye | 23 | IV | | 998 | B |
| Dye | 25–26 | VIII | 649–650 | 1003 | VIII |
| Development Accelerating Agent | 29 | XXI | 648 upper right | | |
| Stabilizing Agent | 24 | IV | 649 upper right | 1006–7 | VI |
| Brightening Agent | 24 | V | | 998 | V |
| Hardener | 26 | X | 651 left | 1004–5 | X |
| Surfactant | 26–27 | XI | 650 right | 1005–6 | XI |
| Plasticizer | 27 | XII | 650 right | 1006 | XII |
| Slipping Agent | 27 | XII | | | |
| Matting Agent | 28 | XVI | 650 right | 1008–9 | XVI |
| Binder | 26 | XXII | | 1003–4 | IX |
| Support | 28 | XVII | | 1009 | XVII |

The support used in the silver halide photographic light-sensitive material of the invention includes a support described on page 28 of RD-17643 and on page 1009 of RD-308119 above. The suitable support includes a polyethylene-terephthalate film. In order to enhance adhesivity of the surface of the support to a coating layer, a subbing layer may be provided on the support or corona discharge and UV ray irradiation may be given to the surface.

The silver halide emulsion layer according to the invention can be coated on one or each side of the above obtained support.

The silver halide emulsion layer according to the invention may optionally comprise an antihalation layer, an intermediate layer or a filter layer.

In a method of forming an image comprising imagewise exposing a light-sensitive material having a light-sensitive silver halide emulsion layer on each side of a support sandwiched between two fluorescent screens by an X-ray radiation, a layer reducing crossover light, which passes through a protective layer, an emulsion layer and the support and reaches the other emulsion layer on the side of the support opposite the emulsion layer, is preferably provided between the support and other layers. The layer reducing crossover light includes a hydrophilic colloid dye layer.

For the measurement of crossover one sheet fluorescent screen is used. The fluorescent screen is positioned in contact with a photographic light-sensitive material having a light-sensitive layer on each side of a support, and then a black paper is positioned in contact with the photographic light-sensitive material on the side of the support opposite the fluorescent screen. Thereafter, the resulting composite material is exposed to an X-ray from the black paper side varying an X-ray exposure by changing a distance between a focal spot of an X-ray generating apparatus and the fluorescent screen. The exposed material is developed and then divided into two portions. The light-sensitive layer of the one portion (a light-sensitive layer on the back side), which was in contact with the fluorescent screen, is peeled off and the light-sensitive layer of the other portion (a light-sensitive layer on the front side), which was in contact with the black paper, is peeled off. Subsequently, densities of the resulting materials are measured and plotted against the exposures to obtain characteristic curves. The average value $\overline{\Delta\log E}$ of sensitivity difference $\Delta\log E$ between each sensitivity in each straight line portion of the above obtained curves is calculated. Then, crossover is calculated from the following equation:

$$\text{Crossover (\%)}=100/\text{antilog}(\overline{\Delta\log E})+1$$

The representative silver halide photographic light-sensitive material used in the invention comprises a blue-colored transparent support and provided on each side of the support, a subbing layer, a dye layer for reducing crossover, at least one light-sensitive silver halide emulsion layer and a protective layer in this order. Each layer on each side of the support is preferably the same as each other.

The support is made of a transparent material such as polyethyleneterephthalate, and colored by a blue dye. As the blue dye can be used various dyes such as anthraquinone type dyes known as colorants for an X-ray film. The thickness of the support may be optionally selected from a range of 80 to 200 μm. A subbing layer composed of a water soluble polymer such as gelatin may be provided on the support in the same manner as in an ordinary X-ray film.

On the subbing layer is preferably provided a dye layer for reducing crossover. It is preferable that the dye layer is ordinarily formed as a colloid layer containing a dye and is decolored in the photographic processing as above described. It is also preferable that the dye is fixed to the lower portions of the dye layer so that it does not diffuse to the upper light-sensitive silver halide emulsion or protective layer.

The dye content of the dye layer may vary depending on dyes used, but is preferably 5–300 mg/m$^2$, and more preferably 50–150 mg/m$^2$.

Various methods for promoting decoloration of a dye and fixing a dye in the dye colloidal layer are known. There are, for example, methods such as a method using a combination of a cationic mordant and an anionic dye as described in EP Patent Publication No. 211273B1, a method using a combination of an anionic dye and a polymer dispersion as a mordant obtained by polymerizing an ethylenically unsaturated monomer having an anionic functional group in the presence of a cationic mordant as described in Japanese Patent O.P.I. Publication No. 2-207242, and a method using a solid fine crystal dye (fine crystalline dye particles). Of these methods the method using a solid fine crystal dye is preferable. The above dye layers are effective for obtaining crossover of 15 to 5%.
Examples of anionic dyes used when a cationic mordant and an anionic dye are combined for forming a dye layer will be shown below.
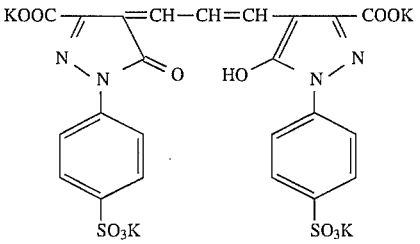
(a)
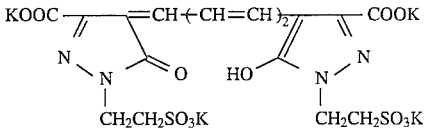
(b)
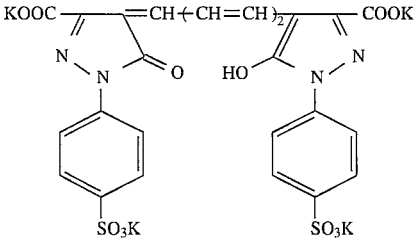
(c)
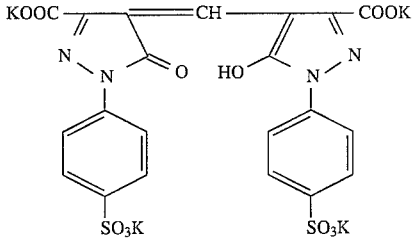
(d)
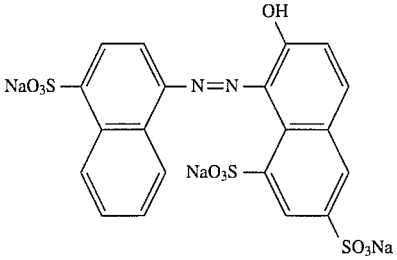
(e)
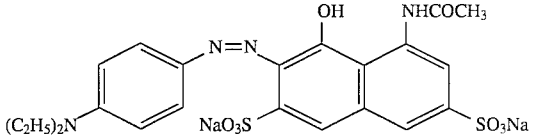
(f)
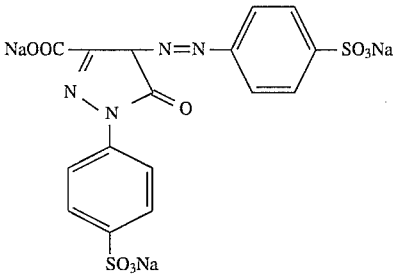
(g)
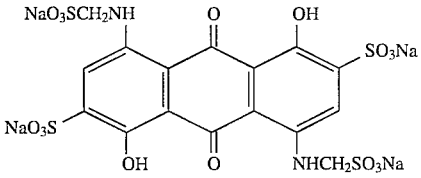
(h)
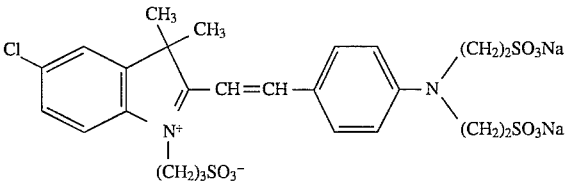
(i)
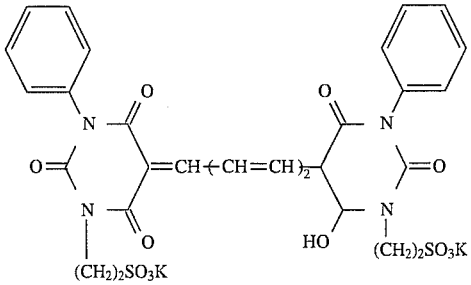
(j)

-continued
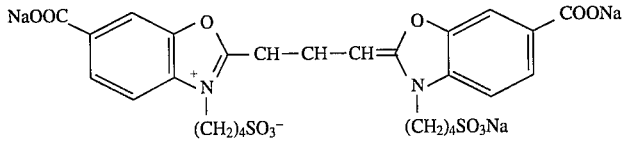
(k)
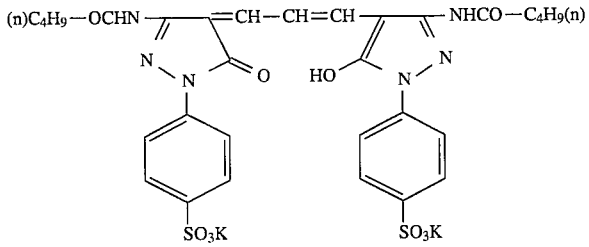
(l)
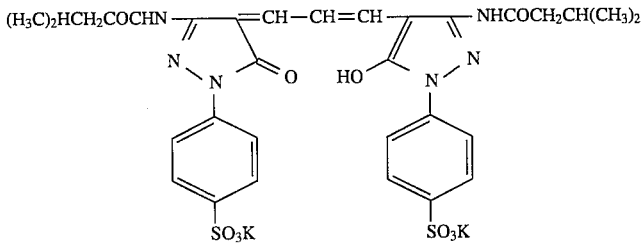
(m)
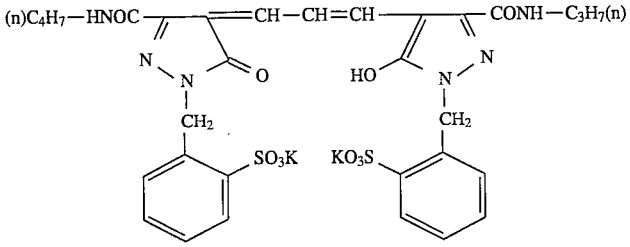
(n)
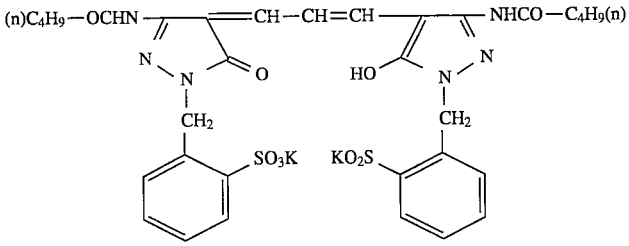
(o)
Examples of solid fine crystal dyes used when the dye layer is formed with solid fine crystals are as follows:
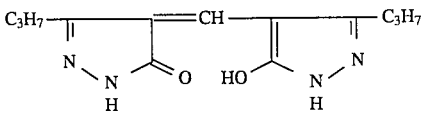
(AH-1)
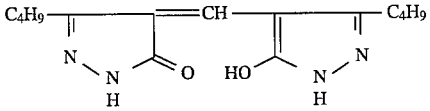
(AH-2)
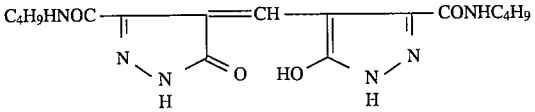
(AH-3)
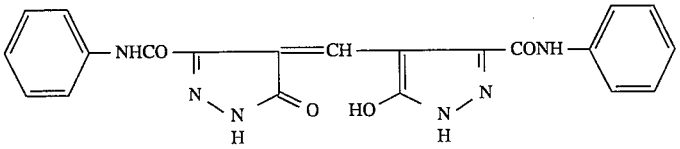
(AH-4)

-continued
(AH-5)
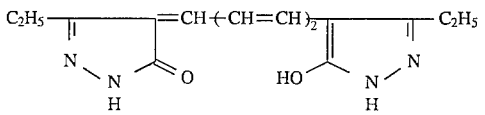
(AH-6)
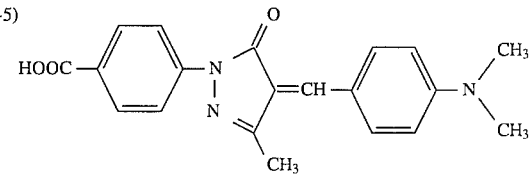
(AH-7)
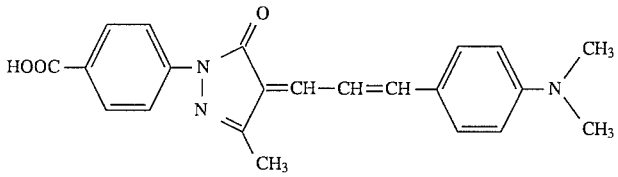
(AH-8)
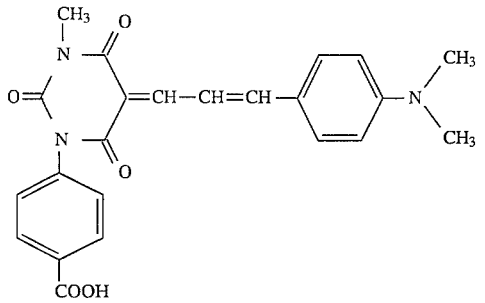
(AH-9)
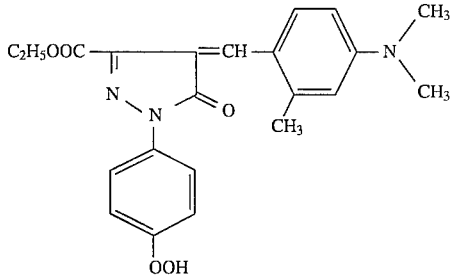
(AH-10)
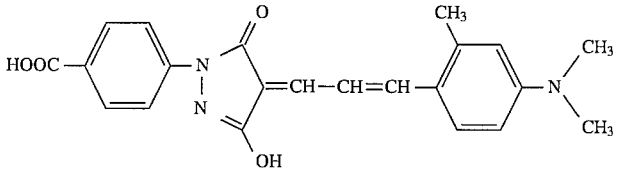
(AH-11)
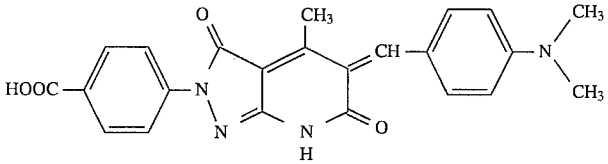
(AH-12)
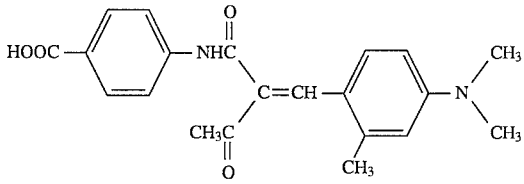
(AH-13)
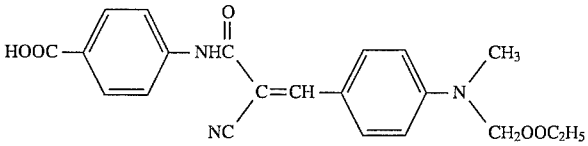
(AH-14)
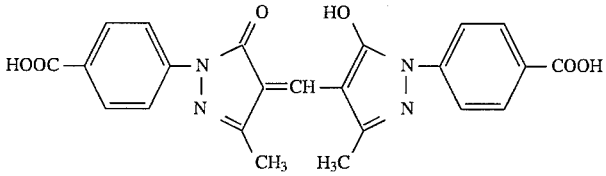

-continued (AH-15)

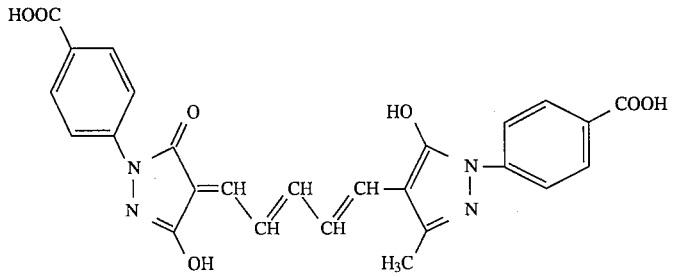

(AH-16)

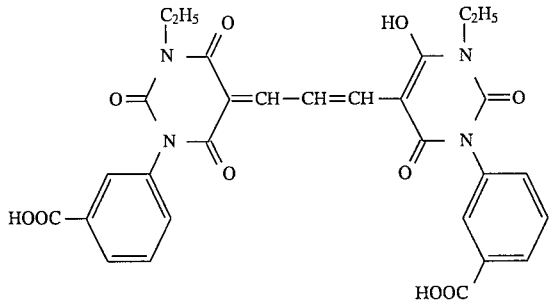

(AH-17)

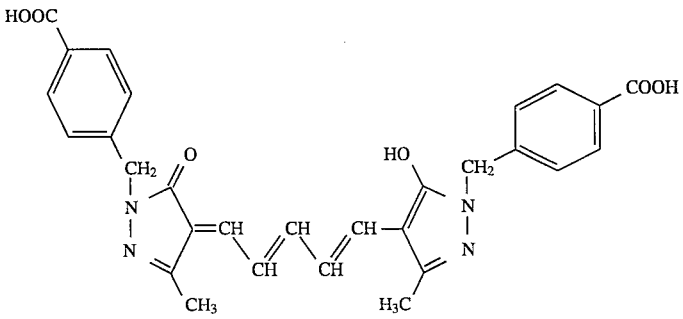

(AH-18)

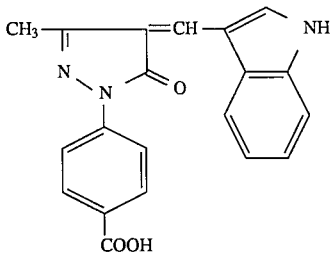

(AH-19)

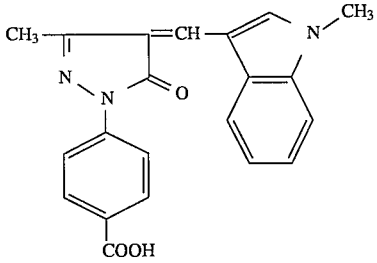

When the invention is applied to X-ray radiography for medical use, intensifying screens are used which comprise as a main component a fluorescent substance capable of emitting a visible or near ultra-violet light by absorbing a transmitting radiation. The intensifying screens are in close contact with both surface of a light-sensitive material having an emulsion layer on each side of a support and the resulting material is exposed.

The preferable as a fluorescent substance used for the fluorescent screen of the invention will be shown below.

Tungstate type fluorescent substances ($CAWO_4$, $MgWO_4$, $CaWO_4$:Pb), terbium-activated rare earth acid sulfide fluorescent substances [$Y_2O_2S$:Tb, $Gd_2O_2S$:Tb, $La_2O_2S$:Tb, $(Y.Gd)_2O_2S$:Tb, $(Y.Gd)O_2S$:Tb. Tm etc.], terbium-activated rare earth metal phosphate fluorescent substances ($YPO_4$:Pb, $GdPO_4$:Tb, $LaPO_4$:Tb etc), terbium-activated rare earth oxy halogenated fluorescent substances (LaOBr:Tb, LaOBr:Tb.Tm, LaOCl:Tb, LaOCl:Tb.Tm, LaOCl:Tb.Tm.LaOBr:Tb GdOBr:TbGdOCl:Tb etc.) and thulium-activated rare earth oxy halogenated fluorescent substances (LaOBr:Tm, LaOCl:Tm etc.), Barium sulfate type fluorescent substances ($BaSO_4$:Pb, $BaSO_4$:$Eu^{2+}$, $(Ba.Sr)SO_4$:$Eu^{2+}$), divalent europium activated alkali earth metal phosphate type fluorescent substances ([$(Ba_2PO_4)_2$:$Eu^{2+}$, $(Ba_2PO_4)_2$:$Eu^{2+}$], divalent europium activated alkali earth metal fluoride halide type fluorescent substances [BaFCl:$Eu^{2+}$, BaFGr:$Eu^{2+}$, BaFCl:$Eu^{2+}$.Tb, BaFBr:$Eu^{2+}$.Tb, $BaF_2$.BaCl.KCl:$Eu^{2+}$, $(Ba.Mg)F_2$.BaCl.KCl:$Eu^{2+}$], iodide type fluorescent substances (CsI:Na, CsI:Tl, NaI, KI:Tl), sulfide type fluorescent substances (ZnS:Ag(Zn.Cd)S:Ag, (Zn.Cd)S:Cu, (Zn.Cd)S:Cu.Al), and hafnium phosphate type fluorescent substances ($HfP_2O_7$:Cu) are cited. However, the invention is not limited thereto, and any fluorescent substances can be used which can emit a visible or near ultraviolet light by absorbing an X-ray radiation.

The fluorescent screen of the invention contains a fluorescent substance in an inclination particle structure. It is preferable that larger fluorescent particles are positioned on the surface of a protective layer and less fluorescent particles are positioned on the vicinity of the support. The less fluorescent particles have preferably 0.5–2.5 μm, and the larger fluorescent particles have preferably 10–30 μm.

For producing a fluorescent screen, it is preferable to produce it by a production method including ① a step forming a fluorescent substance sheet composed of a binder and a fluorescent substance, ② a step providing the above-mentioned fluorescent substance sheet on a support and adhering the above-mentioned fluorescent substance sheet on the support while compressing at a softening or melting point or more of the above-mentioned binder.

The fluorescent substance sheet which is a fluorescent substance layer of the fluorescent screen in ① can be produced by coating a coating solution, wherein a fluorescent substance is dispersed uniformly in a binder solution, on a tentative support for forming the fluorescent substance sheet, drying and peeling it off from the tentative support. Namely, first of all, a binder and fluorescent substance particles are added to an appropriate organic solvent and then, stirred to prepare a coating solution wherein the fluorescent substance is dispersed uniformly in the binder solution.

As a binder, a thermoplastic elastomer whose softening temperature or a melting point is 30° to 150° C. is used singly or in combination with other binder polymers. The thermoplastic elastomer has elasticity at room temperature and has fluidity when heated. Therefore, it can prevent damage of the fluorescent substance due to pressure in compression. As examples of a thermo-plastic elastomer, polystyrene, polyolefin, polyurethane, polyester, polyamide, polybutadiene, ethylene vinyl acetate copolymer, poly vinyl chloride, natural rubbers, fluorine-containing rubbers, polyisoprene, chlorinated polyethylene, styrene-butadiene rubbers and silicone rubbers are cited. The component ratio of thermo-plastic elastomer in the binder is allowed to be 10 wt % or more and 100 wt % or less. However, it is desirable that the binder is composed of the thermo-plastic elastomer as much as possible, especially is composed of a thermo-plastic elastomer of 100 wt %.

As examples of a solvent for preparing a coating solution, lower alcohols such as methanol, ethanol, n-propanol and n-butanol; chlorine-containing hydrocarbons such as methylenechloride and ethylenechloride; ketones such as acetone, methylethylketone and methylisobutylketone; esters of lower fatty acids and lower alcohols such as methyl acetate, ethyl acetate and butyl acetate; ethers such as dioxane, ethyleneglycolmonoethylether and ethyleneglycoholmonomethylether and their mixtures can be cited. The mixture ratio between the binder and the fluorescent substance in the coating solution varies depending upon the characteristic of the radiographic intensifying screen and the kind of fluorescent substance. Generally, the mixture ratio of the binder and the fluorescent substance is selected from 1:1 through 1:100 (by weight), and preferably selected from 1:8 through 1:40 (by weight).

Various additives such as a dispersant for improving dispersing property of a fluorescent substance in aforesaid coating solution and a plasticizer for improving binding force between a binder and a fluorescent substance in the fluorescent substance layer after being formed may be mixed. Examples of a dispersant used for the above-mentioned purpose include phthalic acid, stearic acid, capronic acid and lipophilic surfactants may be cited. Examples of a plasticizer include phosphates such as triphenyl phosphate, tricresyl phosphate and diphenyl phosphate; phthalates such as diethyl phthalate and dimethoxyethyl phthalate; ester glycols such as ethylphthalylethyl glycolate and butylphthalylbutyl glycolate; and polyesters of polyethylene glycols and aliphatic dibasic acids such as polyester of triethylene glycol and adipic acid and polyester between diethylene glycol and succinic acid are cited. Next, the coating layer is formed by coating the coating solution containing the fluorescent substance and the binder prepared in the above-mentioned manner on the tentative support for forming a sheet uniformly. This coating operation can be conducted by the use of a conventional means such as a doctor blade method, a roll coater method and a knife coater method.

A material of the tentative support includes various substances such as glass, wool, cotton, paper and metal. A flexible sheet or a material capable of forming a roll plate is preferable in view of ease of handling as a recording material. The especially preferable is plastic films such as cellulose acetate, polyester, polyethylene terephthalate, polyamide, polyimide, triacetate and polycarbonate, metallic sheets such as aluminium foil and aluminium alloy foil, an ordinary paper, paper for printing such as paper for photography, coat paper and art paper, converted paper such as baryta paper, resin-coated paper, paper sized with polysaccharides as described in Belgium Patent No. 784, 615, pigment paper containing a pigment such as titanium dioxide and paper sized with polyvinyl alcohol. A coating solution for forming a fluorescent substance layer is coated on the tentative support and dried. Following this, the coating layer is peeled off from the tentative support so that the fluorescent substance sheet which will be a fluorescent substance layer of a fluorescent screen is formed. Therefore, it is desirable that a mold-releasing agent is coated on the surface of the tentative support and that the fluorescent substance sheet formed is easily peeled off from the tentative support.

Next, step ② will be explained. A support for a fluorescent substance sheet prepared in the above-mentioned manner is prepared. This support can be selected arbitrarily from the materials as described above. In the conventional fluorescent screen, a polymer substance such as gelatin is coated on the surface of a support to provide a subbing layer for giving adhesiveness in order to strengthen binding between a support and a fluorescent substance layer and a light-reflection layer comprising a light-reflective substance such as titanium dioxide or a light-absorption layer comprising a light-absorptive substance such as carbon black is provided in order to improve sensitivity or image quality (sharpness and graininess).

The support used in the present invention may be provided with each of the above-mentioned layer. The constitution may be arbitrarily selected depending upon the purpose and application of the desired fluorescent screen.

The fluorescent substance sheet obtained through step ① is provided on a support. Next, the fluorescent substance sheet is adhered to the support while compressing it at a softening or melting point or higher of the binder.

In the above-mentioned manner, by the use of a method that compress the fluorescent substance sheet without fixing it on the support in advance, the sheet can be spread thinly. Accordingly, it prevents damage of the fluorescent substance. In addition, compared to a case wherein the sheet is fixed for being pressed, a higher fluorescent substance filling rate can be obtained even with the same pressure.

Examples of a compressor used for compressing processing of the present invention include conventional ones such as a calender roll and a hot press. In compression processing by the use of the calender roll, the fluorescent substance sheet obtained through step a) is loaded on the support, and then, the sheet is passed through rollers heated to the softening temperature or the melting point of the binder or higher at a certain speed. However, a compressor used for the present invention is not limited thereto. Any compressing means can be used, provided that it can compress the sheet while heating it. The compression pressure is preferably 50 kg/cm$^2$ or more.

In an ordinary fluorescent screen, a transparent protective layer is provided for protecting the fluorescent substance layer physically and chemically on the surface of the fluorescent substance layer opposite to that being in contact with the support, as described before. Such a protective layer is preferably provided in the fluorescent screen of the present invention. Layer thickness of the protective layer is ordinarily in a range from about 0.1 to 20 μm.

The transparent protective layer can be formed by a method that coats a solution prepared by dissolving a transparent polymer such as cellulose derivatives including cellulose acetate and nitro cellulose; and a synthetic polymer including polymethyl methacrylate, polyvinyl butyral, polyvinyl formal, polycarbonate, polyvinyl acetate, vinyl chloride-vinyl acetate copolymer on the surface of the fluorescent substance layer.

In addition, the transparent protective layer can also be formed by a method that forms a sheet for forming a protective layer such as a plastic sheet composed of polyethylene terephthalate, polyethylene naphthalate, polyethylene, polyvinylidene chloride or polyamide; and a protective layer forming sheet such as a transparent glass plate is formed separately and they are adhered on the surface of the fluorescent substance layer by the use of an appropriate adhesive agent.

As a protective layer used for the fluorescent screen of the present invention, a layer formed by a coating layer containing an organic solvent soluble fluorescent resin is preferable. As a fluorescent resin, a polymer of a fluorine-containing olefin (fluoro olefin) or a copolymer of a fluorine-containing olefin is cited. A layer formed by a fluorine resin coating layer may be cross-linked. When a protective layer composed of a fluorine resin is provided, dirt exuded from a film in contacting with other materials and an X-ray film is difficult to come into inside of the protective layer. Therefore, it has an advantage that it is easy to remove the dirt by wiping.

When an organic solvent soluble fluorescent resin is used as a material for forming a protective layer, it can be formed easily by coating a solution prepared by dissolving this resin in a suitable solvent and drying it. Namely, the protective layer is formed by coating the protective layer forming material coating solution containing the organic solvent soluble fluorine resin on the surface of fluorescent layer uniformly by the use of the doctor blade and by drying it. This formation of a protective layer may be conducted concurrently with the formation of the fluorescent substance layer by the use of multilayer coating.

The fluorine resin is a homopolymer or copolymer of a fluorine containing olefin (fluoroolefin). Its examples include polytetrafluoroethylene, polychlorotrifluoroethylene, polyvinyl fluoride, polyvinylidene fluoride, tetrafluoroethylene-hexafluoropropylene copolymer and fluoroolefin-vinyl ether copolymer.

Though fluorine resins are insoluble in an organic solvent, copolymers of fluoroolefins as a copolymer component are soluble in an organic solvent depending upon other constituting units (other than fluoroolefin) of the copolymers. Therefore, the protective layer can be formed easily by coating a solution wherein the aforesaid resin is dissolved in a suitable solvent for preparing on the fluorescent substance layer to be dried. Examples of the above-mentioned copolymers include fluoroolefin-vinylether copolymer. In addition, polytetrafluoroethylene and its denatured product are soluble in a suitable fluorine-containing organic solvent such as a perfluoro solvent. Therefore, they can form a protective layer in the same manner as in the copolymer containing the above-mentioned fluoroolefin as a copolymer component.

To the protective layer, resins other than the fluorine resin may be incorporated. A cross-linking agent, a hardener and an anti-yellowing agent may be incorporated. However, in order to attain the above-mentioned object sufficiently, the content of the fluorine resin in the protective layer is suitably 30 wt % or more, preferably 50 wt % or more and more preferably 70 wt % or more.

Examples of resin incorporated in the protective layer other than the fluorine resin include a polyurethane resin, a polyacrylic resin, a cellulose derivative, polymethyl-methacrylate, a polyester resin and an epoxy resin.

The protective layer for the fluorescent screen used in the present invention may be formed by either of an oligomer containing a polysiloxane skeleton or an oligomer containing a perfluoroalkyl group or by both thereof.

The oligomer containing the polysiloxane skeleton has, for example, a dimethyl polysiloxane skeleton. It is preferable to have at least one functional group, for example, a hydroxyl group. In addition, the molecular weight is preferably in a range from 500 to 100000, more preferably 1000 to 100000, and especially more preferably 3000 to 10000. In addition, the oligomer containing the perfluoroalkyl group, for example, a tetrafluoroethylene group, preferably contains at least one functional group, for example, a hydroxyl group, in a molecule. Its molecular weight is 500 to 100000, more preferably 1000 to 100000 and especially preferably 10000 to 100000.

When an oligomer containing a functional group is used, cross-linking reaction occurs between the oligomer and a resin for forming a protective layer in forming the protective layer so that the oligomer is taken into a molecule structure of the layer-forming resin. Therefore, even when the fluorescent screen is used for a long time repeatedly or cleaning operation of the surface of the protective layer is carried out, the oligomer is not taken off from the protective layer. Therefore, the addition of the oligomer becomes effective for a long time so that use of the oligomer having a functional group becomes advantageous. The oligomer is contained in the protective layer preferably in an amount of 0.01 to 10 wt % and especially 0.1 to 2 wt %.

In the protective layer, perfluoro olefin resin powder or silicone resin powder may be added. As the perfluoro olefin resin powder or the silicone resin powder, those having an average particle size of preferably 0.1 to 10 μm, and more preferably 0.3 to 5 μm. The above-mentioned perfluoro olefin resin powder or the silicone resin powder is added to the protective layer preferably in an amount of 0.5 to 30 wt % and more preferably 2 to 20 wt % and especially preferably 5 to 15 wt %.

The protective layer of the fluorescent screen is preferably a transparent resin layer having a thickness of 5 μm or less which is provided on a fluorescent substance layer. This thin protective layer contributes to improvement of an X-ray image sharpness, since the distance between a fluorescent substance of a fluorescent screen and an silver halide emulsion layer is short.

The filling rate referred to in the invention is obtained from void rate of a fluorescent layer provided on a support by the following equation:

$$V_{air}/V=(a+b)p_xp_yV-A(ap_x+bp_y)/V[(a+b)p_xp_y-ap_y\text{pair}-bp_x\text{pair}] \quad \text{Equation (1)}$$

V; total volume of a fluorescent layer $V_{air}$; volume of air in the fluorescent layer A; total weight of a fluorescent layer Px; density of a fluorescent substance Py; density of a binder $P_{air}$; density of air a; weight of a fluorescent substance b; weight of a binder Since $P_{air}$ is almost zero in equation (1), the equation (1 ) is approximately represented by the following equation (2):

$$V_{air}/V=(a+b)p_xp_yV-A(ap_x+bp_y)/V[(a+b)p_xp_y] \quad \text{Equation (2)}$$

wherein V, $V_{air}$, $P_x$, $P_y$, a and b are the same as those defined in equation (1) .

The void rate of the fluorescent layer in the invention is obtained from equation (2). The filling rate of a fluorescent substance can be obtained from the following equation (3):

$$V_{air}/V=Aap_x/V[(a+b)p_xp_y] \quad \text{Equation (3)}$$

wherein V, $V_{air}$, $p_x$, $p_y$, a and b are the same as those defined in equation (1).

In the invention fluorescent screens having various filling rates of a fluorescent substance or various thicknesses are used. Using an X-ray radiation apparatus having a specific filtration equivalent to a 2.2 mm aluminium, a combination use of fluorescent screen A having an absorption of 40% or more of a 80 kVp X-ray energy and fluorescent screen B having an absorption of 50% or more of a 80 kVp X-ray energy and more absorption than fluorescent screen A is preferable. The X-ray absorption can be measured by the following method.

An X-ray created from a tungsten target tube operated at 80 kVp by a three phase power supply was transmitted through an aluminum plate with thickness of 3 mm to be reached to a sample fluorescent screen fixed at a position of 200 cm from the tungsten anode of the target tube. Next, the amount of X-ray transmitted through the fluorescent screen was measured by the use of an electrolytic dosimeter at a position of 50 cm separating from the fluorescent substance layer of the fluorescent screen to obtain an absorption amount of the X-ray. As a standard value, a measurement value was measured in the same manner as above, except that the X-ray was not transmitted through the fluorescent screen was used.

The thickness of the fluorescent layer is preferably 120 μm or more. The fluorescent layer thickness of fluorescent screen A is preferably 120 μm or more and that of fluorescent screen B is preferably 150 μm or more. In addition, the filling rate of the fluorescent substance is preferably 65% or more.

In the preferable mode of the invention fluorescent screen A having an absorption of 40% or more of a 80 kVp X-ray energy and an absorption of a 80 kVp X-ray energy of fluorescent screen B is 25% or more, and more preferably, 30% or more higher than that of fluorescent screen A.

The fluorescent screen of the invention can be produced according to the method disclosed in Japanese Patent O.P.I. Publication No. 6-75097/1994. That is, the production method by a combination of a fluorescent substance, a binder or a material for a protective layer or a conductive layer is preferably carried out according to the method disclosed in Japanese Patent O.P.I. Publication No. 6-75097/1994. The fluorescent substance is preferably multilayer-coated so that larger particles are located near the surface of a protective layer.

In the preferable mode of the silver halide photographic light-sensitive material of the invention the material has a sensitivity that, when the material is exposed to a monochromatic light having the same wavelength as a main emission peak wavelength of the screens showing the X-ray absorption as specified described above and having a half band width of 15±5 nm, developed with the exposed material at 35° C. for 25 seconds with the following developer (hereinafter referred to as standard developer), and the density of the developed material, after a light-sensitive layer on the side opposite the exposed side is peeled off, is measured, an exposure necessary to give a density of the minimum density+0.5 is 0.027 to 0.040 lux·second,

| Developer | |
|---|---|
| Potassium hydroxide | 21 g |
| Potassium sulfite | 63 g |
| Boric acid | 10 g |
| Hydroquinone | 26 g |
| Triethylene glycol | 16 g |
| 5-methylbenzotriazole | 0.06 g |
| 1-phenyl-5-mercaptotetrazole | 0.01 g |
| Glacial acetic acid | 12 g |
| 1-phenyl-3-pyrazolidone | 1.2 g |
| Glutaraldehyde | 5 g |
| Potassium bromide | 4 g |

Water added to 1 liter, and pH adjusted to 10.0.

When sensitivity of the light-sensitive material is measured, the wavelength of a light source used must be identical or substantially identical to an emission peak wavelength of the screens used in combination. For example, when the fluorescent substance of fluorescent screens is terbium activated gadolinium oxysulfide having an emission peak wavelength of 545 nm, the light source for measuring sensitivity should have light of 545 nm or around. The method for obtaining a monochromatic light includes a method using an optical system in combination with an interference filter. According to this method, a monochromatic light can be easily obtained which has an necessary exposure and a half band width of 15±5 nm, although it depends upon a combination with an interference filter. The light-sensitive material has continuous spectral sensitivity and no change in sensitivity in a wavelength range of 15±5 nm, regardless of whether or not spectrally sensitized.

When the fluorescent substance of the screens is terbium activated gadolinium oxysulfide, the example of the light source includes a system in combination of a tungsten light source whose color temperature is 2856K as an irradiation light with a filter having a filter property as shown in FIG. 1. The exposure is obtained using illuminator IM-3 (produced by TOPCON Co., Ltd.). Sensitivity is measured at an exposure time of 1/25 seconds.

The standard developing conditions using the standard developer above are as follows:

Developing time: 25 seconds

Fixing time : 20 seconds (Fixer composition will be shown below.)

Squeezing and drying time: 26 seconds

Developing apparatus: Roller transporting commercially available automatic developing apparatus ,for example, FPM-500 automatic processor produced by Fuji Photo Film Co., Ltd., comprising a developing tank having a 22 liter content and 35° C. solution temperature and a fixing tank having a 15.5 liter content and 25° C. solution temperature or M-6AW automatic processor produced by Eastman Kodak Co., Ltd.

Fixer Composition (hereinafter referred to as fixer F)

| | |
|---|---|
| Ammonium thiosulfate (70 weight/volume %) | 200 ml |
| Sodium sulfite | 20 g |
| Boric acid | 8 g |
| Disodium ethylenediamine tetraacetate (dihydrate) | 0.1 g |
| Aluminium sulfate | 15 g |
| Sulfuric acid | 2 g |
| Glacial acetic acid | 22 g |

Water added to make al liter, and adjusted to pH 4.20 optionally using a sodium hydroxide or glacial acetic acid solution.

In the invention the light-sensitive material comprising a transparent support and at least one light-sensitive silver halide emulsion layer provided on each side of the support is sandwiched between two fluorescent screens. When the resulting composite is imagewise exposed, the material being sandwiched between the screens A and B, so that emulsion layer A is in close contact with screen A and emulsion layer B is in close contact with screen B, and screen A being positioned on the X-ray radiation source, and the exposed material is developed the slope of the straight portion of emulsion layer A in the obtained characteristic curves is preferably less than that of emulsion layer B. More preferably, sensitivity of emulsion layer A is higher than that of emulsion layer B.

The silver halide photographic light-sensitive material light-sensitive material of the invention may be processed with processing solutions as described on pages 29 and 30 of RD-17643, XX–XXI and on pages 1011 and 1012 of RD-308119, XX–XXI.

As the developing agent of a black and white developer the following can be used singly or in combination: dihydroxy benzenes like hydroquinone, 3-pyrazolidone like 1-phenyl-3pyrazolidone, and aminophenols like N-methyl-p-aminophenol. Besides the above compounds the developer optionally contains various preservatives, alkali agents, pH buffering agents, anti-foggants, a hardener, a development accelerator, a surfactant, an anti-foaming agent, a toning agent, a water softening agent, an auxiliary solubility agent or a viscosity increasing agent.

As a fixing agent in the fixer a thiosulfate or a thiocyanate is used. The fixer may contain a water soluble aluminum salt such as aluminium sulfate or potash alum for a hardener. Beside the above, the fixer may contain a preservative, a pH buffering agent or a water softening agent.

In the invention a light sensitive material can be processed rapidly in the total processing time (Dry to Dry) of 40 seconds or less. In the invention "developing step time" or "developing time" refers to time taken from entry of the leading edge of a film in the developing tank solution of an automatic developing apparatus (hereinafter referred to as automatic processor) to its entry in the next fixer tank solution, "fixing time" refers to time taken from entry of the edge in the fixer tank solution to its entry in the next washing tank solution (stabilizing solution), "washing time" refers to time while the film was immersed in a washing tank solution, and "drying time" refers to time while the film was passing a drying zone supplied with a hot air of 35°–100° C., and more preferably, 40°–80° C., with which the automatic processor is usually equipped. In the invention, developing time is 3–15 seconds, and preferably 3–10 seconds, developing temperature is preferably 25°–50° C., and more preferably 30°–40° C., fixing temperature and fixing time are preferably 20°–50° C. and 2–12 seconds, and more preferably 30°–40° C. and 2–10 seconds, respectively. A washing or stabilizing temperature and time are preferably 0°–50° C. and 2–15 seconds, and more preferably 15°–40° C. and 2–8 seconds, respectively.

According to the invention, the developed, fixed and washed silver halide photographic light-sensitive material is dried after passing between squeezing rollers to squeeze a washing water. The drying temperature is 40°–100° C., and the drying time, depending the drying temperature, is usually 3–12 seconds, preferably 3–12 seconds at 40°–80° C., and more preferably 3–8 seconds at 40°–80° C. An extra infrared heater is preferably used.

In the light sensitive material a photographic emulsion layer or other hydrophilic colloid layers can be coated on a support or other layers by various coating methods. The coating methods include a dip coating method, a roller coating method, a curtain coating method, an extrusion coating method and a slide-hopper coating method. The methods are detailed in item "Coating procedures" in Research and Disclosure, Vol. 176, p.27–28.

EXAMPLES

The examples of the invention will be explained below, but the invention is not limited thereto.

EXAMPLE 1

| (Preparation of silver iodide fine particles) | |
|---|---|
| Solution A | |
| Ossein gelatin | 100 g |
| KI | 8.5 g |
| Distilled water added to | 2000 ml. |
| Solution B | |
| $AgNO_3$ | 360 g |
| Distilled water added to | 605 ml. |
| Solution C | |
| KI | 352 g |

Distilled water added to 605ml.

In a reaction vessel was placed Solution A, and Solutions B and C were added in 30 minutes at a constant rate while stirring by a double-jet method. During the addition pAg was maintained at 13.5 by the conventional pAg controlling method. The resulting silver iodide grains were a mixture of β-AgI and γ-AgI each having an average grain size of 0.06 μm. The above obtained emulsion was defined to be a fine grain silver iodide emulsion.

(Preparation of solid fine particle dispersion of a spectral sensitizer)

The following spectral sensitizers (A) and (B) in a ratio of 100:1 were added to water at 27° C. The resulting mixture was stirred at 3500 rpm for 30 to 120 minutes by means of a high speed stirrer (dissolver) to obtain a solid spectral sensitizing dye fine particle dispersion. The dispersion was adjusted to have a spectral sensitizer (A) concentration of 2%

Spectral Sensitizer A

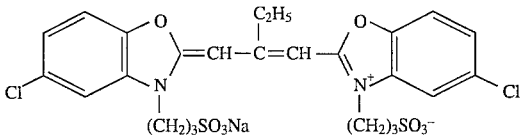

Spectral Sensitizer B

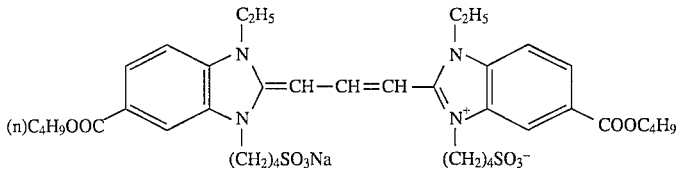

(Preparation of hexahedral tabular seed emulsion)

An octahedral tabular seed emulsion Em-A was prepared by the following method.

| | |
|---|---|
| <Solution A> | |
| Ossein gelatin | 60.2 g |
| Distilled water | 20.0 liter |
| $H—(CH_2CH_2O)_n—[CH(CH_3)—CH_2O]_{17}—(CH_2CH_2O)_m—H$ (m + n = 5–7) (10% methanol solution) | 5.6 ml |
| KBr | 26.8 g |
| 10% $H_2SO_4$ | 144 ml |
| <Solution B> | |
| $AgNO_3$ | 1487.5 g |
| Distilled water was added to make | 3500 ml. |
| <Solution C> | |
| KBr | 1029 g |
| KI | 29.3 g |
| Distilled water was added to make | 3500 ml. |
| <Solution D> | |
| Aqueous 1.75N KBr solution | an amount for controlling the following silver potential |

By the use of a mixing stirrer described in Japanese Patent Publication Nos. 58288/1983 and 58289/1982, 64.1 ml of each of Solution B and Solution C were added to Solution A in minutes at 35° C. by a double-jet method to form a nuclei.

After addition of Solutions B and C was stopped, the temperature of Solution A was elevated to 60° C. spending 60 minutes. Then, solutions B and C each were added by means of a double jet method for 50 minutes at a flow rate of 68.5 ml/min. During the addition the silver potential (measured by means of a silver ion selecting electrode and a saturated silver-silver chloride reference electrode) was regulated to+6 mv using Solution D. After the addition, pH was regulated to 5.0 with 3% KOH. Immediately after that, it was subjected to desalting and washing to obtain seed emulsion Em-A. It was observed by an electron microscope that this seed emulsion was composed of hexahedral tabular grains, in which 90% or more of the total projected area of silver halide grains have a maximum adjacent side ratio of 1.0 to 2.0, having an average thickness of 0.07 μm, an average diameter (converted to a circle) of 0.5 μm and a deviation coefficient of 25%.

(Preparation of tabular emulsion Em-1)

The tabular silver iodobromide emulsion Em-1 containing 1.3 mol% of silver iodide was prepared using the following five kinds of solutions.

| | |
|---|---|
| <Solution A> | |
| Ossein gelatin | 29.4 g |
| $H—(CH_2CH_2O)_n—[CH(CH_3)—CH_2O]_{17}—(CH_2CH_2O)_m—H$ (m + n = 5–7) (10% methanol solution) | 1.25 ml |
| Seed emulsion Em-A amount equivalent to | 2.65 mol Ag |
| Distilled water was added to make | 3000 ml. |
| <Solution B> | |
| 3.50N aqueous $AgNO_3$ solution | 1760 ml |
| <Solution C> | |
| KBr | 730 g |
| Distilled water was added to make | 1760 ml. |
| <Solution D> | |
| Silver iodide fine gain emulsion amount equivalent to | 0.06 mol Ag |
| <Solution E> | |
| Aqueous 1.75N KBr solution | an amount for controlling the following silver potential |

Using a mixing stirrer as described in Japanese Patent Publication Nos. 58288/1983 and 58289/1982, 658 ml of each of Solutions B and C and the total amount of Solution D were added to Solution A in 40 minutes at 60° C. by a triple-jet method so that the final flow rate is two times the rate of initial flow rate to grow grains and form a first covering layer.

Subsequently, the remaining amount of Solutions B and C each were added by means of a double jet method in 70 minutes so that the final flow rate is 1.5 times the initial flow rate to grow grains and form a second covering layer. During the addition the silver potential was regulated to+40 mv using Solution D. After the addition, in order to remove excessive salts, the mixture was subjected to precipitation desalting by the use of an aqueous Demol N (produced by Kao Atlas) solution and an aqueous magnesium sulfate solution. The resulting emulsion was mixed with a gelatin solution containing 92.2 g of ossein gelatin and redispersed with stirring to obtain emulsion Em-1.

When about 3000 grains or Em-1 was observed and measured by the use of an electron microscope, they were tabular grains having a circle equivalent average diameter of 0.59 μm, a thickness of 0.17 μm and a variation coefficient of the grain size is 24%.

The emulsion Em-1 was subjected to the following spectral and chemical sensitization. While the resulting emulsion Em-1 was kept being stirred at 50° C., the above described solid fine particle dispersion was added thereto to give a sensitizer (A) amount of 460 mg per 1 mol of silver, and then $7.0\times10_{-4}$ mol per mol of silver of ammonium thiocyanate, $6\times10^{-6}$ mol per mol of silver of chloroauric acid and $6\times10^{-5}$ mol per mol of silver of sodium thiosulfate were added for chemical sensitization, the above-mentioned silver iodide fine grain emulsion was added in an amount of $3\times10^{-3}$ mol per mol of silver and $3\times10^{-2}$ mol per mol of silver of 4-hydroxy-6-methyl-1,3,3a,7-tetrazaindene (TAI) was added thereto for stabilizing.

(Preparation of tabular emulsions Em-2 through Em-4)

Tabular emulsions Em-2 through Em-4 as shown in Table 1 were prepared in the same manner as in Em-1, except that the amount of the seed emulsion, the amount of the silver iodide fine particles, the potential during grain growth and the addition amount of Solutions B, C and D were varied.

TABLE 1

| Emulsion No. | Circle Equivalent Diameter (μm) | Average Thickness (μm) | Deviation Coefficient (%) | Silver Iodide Content (mol %) |
|---|---|---|---|---|
| Em-1 | 0.59 | 0.17 | 24 | 1.3 |
| Em-2 | 0.49 | 0.14 | 25 | 1.3 |
| Em-3 | 0.67 | 0.19 | 23 | 1.3 |
| Em-4 | 0.46 | 0.13 | 23 | 1.3 |

(Preparation of Samples)

To each of the above obtained emulsions were added the following various additives to obtain an emulsion (a light-sensitive silver halide coating solution). The amount is in terms of a weight amount per mol of silver halide.

| | |
|---|---|
| t-Butyl-catechol | 400 mg |
| Polyvinyl pyrrolidone (molecular weight 10,000) | 1.0 g |
| Styrene-maleic acid anhydride copolymer | 2.5 g |
| Trimethylpropane | 10 mg |
| Diethylene glycol | 5 g |
| Nitrophenyl-triphenyl phosphonium chloride | 50 mg |
| Ammonium 1,3-dihydroxybenzene-4-sulfonic acid | 4 g |
| Sodium 2-mercaptobenzimidazole-5-sulfonate | 1.5 mg |
| $n\text{-}C_4H_9OCH_2CH(OH)CH_2N(CH_2COOH)_2$ | 1 g |
| 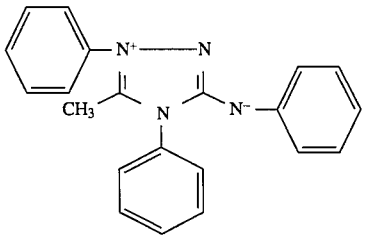 | 150 mg |

-continued

| | |
|---|---|
| 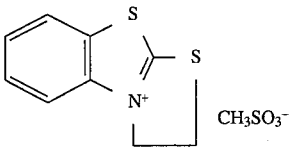 | 70 mg |

Additives used in a protective layer are as follows: The amount is in terms of a weight amount per gram of gelatin.

Coating Solution for Protective Layer

| | |
|---|---|
| Polymethylmethacrylate Matting agent having an area average grain size of 7 μm) | 7 mg |
| Colloid silica (an average grain size of 0.013 μm) | 70 mg |
| Sodium salt of 2,4-dichloro-6-hydroxy-1,3,5-triazine | 30 mg |
| 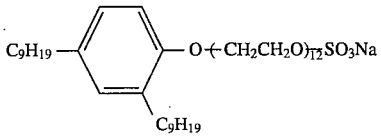 | 12 mg |
| 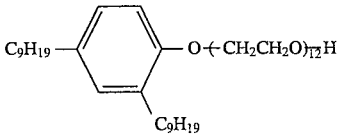 | 2 mg |
| $CH_2COO(CH_2)_9CH_3$ \| $CHCOO(CH_2)_2CH(CH_3)_2$ \| $SO_3Na$ | 7 mg |
| 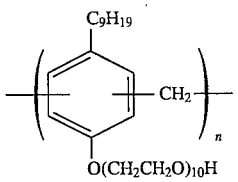 (A mixture of n = 2–5) | 15 mg |
| $F_{19}C_9O(CH_2CH_2O)_{10}CH_2CH_2OH$ | 3 mg |
| $NaO_3S-CHCOOCH_2(C_2F_4)_3H$ \| $CH_2COOCH_2(C_2F_4)_3H$ | 5 mg |
| $(CH_2=CHSO_2CH_2)_2O$ (Hardner) | 36 mg |

The above obtained coating solutions are uniformly coated on each side of a blue colored 180 μm thick polyethylene terephthalate film support having a subbing layer and dried to obtain Samples 1 through 16 as shown in Table 2.

TABLE 2

| Sample No. | | On A Side | | On B Side | | On A Side | | On B Side | |
|---|---|---|---|---|---|---|---|---|---|
| | | | Silver | | Silver | | γ at | | γ at |
| Example 1 | Example 2 | Emulsion No. | Amount (g/m²) | Emulsion No. | Amount (g/m²) | Sensitivity (lux · second) | Straight Portion | Sensitivity (lux · second) | Straight Portion |
| SR-G | | — | — | — | — | 0.013 | 1.37 | 0.013 | 1.37 |
| 1 | 17 | Em-2 | 2 | Em-2 | 2 | 0.039 | 1.35 | 0.039 | 1.35 |
| 2 | 18 | Em-1 | 1 | Em-1 | 1 | 0.035 | 0.59 | 0.035 | 0.59 |
| 3 | 19 | Em-1 | 1 | Em-2 | 2 | 0.035 | 0.59 | 0.039 | 1.35 |
| 4 | 20 | Em-2 | 2 | Em-1 | 1 | 0.039 | 1.35 | 0.035 | 0.59 |
| 5 | 21 | Em-1 | 1 | Em-1 | 2 | 0.035 | 0.59 | 0.027 | 1.35 |
| 6 | 22 | Em-1 | 2 | Em-1 | 1 | 0.027 | 1.35 | 0.035 | 0.59 |
| 7 | 23 | Em-3 | 1 | Em-2 | 2 | 0.027 | 0.59 | 0.039 | 1.35 |
| 8 | 24 | Em-2 | 2 | Em-3 | 1 | 0.039 | 1.35 | 0.027 | 0.59 |
| 9 | 25 | Em-3 | 1 | Em-1 | 2 | 0.027 | 0.59 | 0.027 | 1.35 |
| 10 | 26 | Em-1 | 2 | Em-3 | 1 | 0.027 | 1.35 | 0.027 | 0.59 |
| 11 | 27 | Em-1 | 1 | Em-4 | 2 | 0.035 | 0.59 | 0.045 | 1.35 |
| 12 | 28 | Em-4 | 2 | Em-1 | 1 | 0.045 | 1.35 | 0.035 | 0.59 |
| 13 | 29 | Em-3 | 2 | Em-1 | 2 | 0.021 | 1.35 | 0.027 | 1.35 |
| 14 | 30 | Em-1 | 2 | Em-3 | 2 | 0.027 | 1.35 | 0.021 | 1.35 |
| 15 | 31 | Em-3 | 2 | Em-4 | 2 | 0.021 | 1.35 | 0.045 | 1.35 |
| 16 | 32 | Em-4 | 2 | Em-3 | 2 | 0.045 | 1.35 | 0.021 | 1.35 |

Note: Sensitivity is represented in terms of lux · second by an exposure necessary to give a density of Dmin. + 0.5.

The following fluorescent screen was prepared.

| (Preparation of fluorescent screen 1) | |
|---|---|
| Fluorescent substance ($Gd_2O_2S$:Tb, average particle size of 1.8 μm | 200 g |
| Binder, polyurethane thermoplastic elastomer Demolac TPKL-5-2625, solid content of 40% (produced by Sumitomo Beier Urethane Co., Ltd.) | 20 g |
| Nitrocellulose (nitration degree of 11.5%) | 2 g |

The above composition was added with methylethylketone and dispersed with a propeller mixer to obtain a coating solution having viscosity of 25 ps (25° C.) for a fluorescent substance layer(binder/fluorescent substance ratio=1/22).

Separately, a coating solution for a subbing layer was formed as follows: 90 g of a soft acrylic resin and 50 g of nitrocellulose were added to methylethylketone for mixing and dispersing so that a dispersion solution having viscosity of 3 to 6 ps (25° C.) was prepared.

A 250 μm polyethylene terephthalate support comprising titanium oxide was placed horizontally on a glass plate. The above-mentioned coating solution for a subbing layer was coated on the support uniformly using a doctor blade. Thereafter, the temperature was raised gradually from 25° C. to 100° C. for drying the coating layer to form a subbing layer on the support. The layer thickness of the subbing layer was 15 μm. On this, the above coating solution for a fluorescent substance layer was coated uniformly to give a thickness of 150 μm, dried and subjected to compression operation. The operation was conducted by means of a calender roller at a pressure of 300 Kgw/cm² and temperature of 80° C. Thereafter, a 3 μm transparent protective layer was formed according to a description in Example 1 of Japanese Patent O.P.I. Publication No. 6-75097/1994. Thus, fluorescent screen 1 composed of the support, the subbing layer, the fluorescent substance layer and the transparent protective layer was prepared.

(Preparation of fluorescent screens 2 and 3)

Fluorescent screens 2 and 3 each composed of a support, a subbing layer, a fluorescent layer and a protective layer were prepared to have a thickness of 190 μm and 240 μm, respectively, of the fluorescent layer in the same manner as in fluorescent screen 1 , except that pressure was not applied.

(Measurement of characteristics of fluorescent screens)

1) Measurement of sensitivity

Silver halide photographic light-sensitive material MRE produced by Eastman Kodak Company which has a silver halide emulsion layer on one side of a support was in close contact with a fluorescent screen positioned on the side of the support opposite the emulsion layer and an X-ray source was positioned on the emulsion layer side. Then, the material was subjected to step wedge exposure with width of logE=0.15 in which the X-ray exposure amount was changed by a distance. The exposed material was developed with a method described later which was used for measurement of characteristics of silver halide photographic light-sensitive materials. Thus, sample for evaluation was obtained.

Density of the obtained sample was measured by a visible light to obtain a characteristic curve. Sensitivity is represented by an inverse of an X-ray exposure necessary to obtain a density of Dmin.+1.0 and expressed by a relative sensitivity when sensitivity of screen 1 was defined to be 100. The results are shown in Table 3.

TABLE 3

| Fluorescent Screen No. | Absorption of X-ray (%) | Filling Rate of Fluorescent Screen (%) | Thickness of Fluorescent Screen (μm) | Sensitivity |
|---|---|---|---|---|
| 1 | 37 | 69 | 100 | 100 |
| 2 | 42 | 65 | 130 | 115 |
| 3 | 55 | 65 | 165 | 150 |

2) Measurement of X-ray Absorption

An X-ray created from a tungsten target tube corresponding to a specific filtration of a 2.2 mm aluminium and operated at 80 kVp by a three phase power supply was transmitted through an aluminum plate with thickness of 3 mm to be reached to a sample intensifying screen fixed at a position of 200 cm from the tungsten anode of the target tube. Next, the amount of X-ray transmitted through the fluorescent screen was measured by the use of an electrolytic dosimeter at a position of 50 cm separating from the fluorescent substance layer of the fluorescent screen to obtain an absorption amount of the X-ray. As a standard value, a measurement value was measured in the same manner as above, except that an X-ray which was not transmitted through the fluorescent screen was used. Table 3 shows the measurement value of X-ray absorption values of each fluorescent screen.

(Sensitivity evaluation of a silver halide photographic light-sensitive material)

1) Measurement of sensitivity

By the use of a interference filter having a spectral property as shown in FIG. 1 and a tungsten light source whose color temperature was 2856K as an irradiation light (545 nm or around light was selected by the filter corresponding to a main wavelength of fluorescent screens used together as described later), a light-sensitive material sample and comparative sample, SR-G (produced by Konica Corporation) were exposed and evaluated for sensitivity. The exposure time was 1/25 seconds.

After exposure, the light-sensitive material was developed at 35° C. for 25 seconds (the total processing time was 90 seconds) by the use of automatic processing machine FPM (produced by Fuji Film Co., Ltd.) and the developing solution described above. After a light-sensitive layer on the opposite side of the exposure surface was peeled off, the density was measured for obtaining a characteristic curve. From the characteristic curve, an exposure amount necessary to obtain density of the minimum density (Dmin) plus 0.5 was calculated and defined to be sensitivity. The sensitivity is shown in Table 2 in terms of lux-second. Incidentally, in calculating exposure amount, illuminance emitted from the tungsten light source and transmitted through the filter was measured by the use of illuminator IM-3 (produced by TOPCON Co., Ltd.).

From the curve, the slope of the straight line portions ($\gamma$) was obtained and shown in Table 2.

(Evaluation of a composite of light-sensitive material and fluorescent screen)

Measurement of sensitivity

The composite in which above obtained light sensitive material sample or SR-G was sandwiched between the above screens was subjected through a penetrameter B type to an X-ray exposure and photographic processing using Automatic Processor SRX-503 and Processing Solution SR-DF (each produced by Konica Corporation) at a developing temperature of 35° C. and at a total processing time of 45 seconds. The sensitivity was represented by a relative value of an inverse of an X-ray exposure amount necessary to obtain the minimum density (Dmin)+1.0, with the proviso that the sensitivity of a composite of screen set 1 and light-sensitive material, SR-G, was a standard value (100). The sensitivity is shown in table 4.

Evaluation of sharpness and graininess

Each composite of a light-sensitive material and fluorescent screens was evaluated for sharpness and graininess. Chest phantom produced by Kyoto Kagaku and an X-ray source of 120 kVp (equipped with a filter equivalent to a 3 mm thick aluminum) were used. The phantom was placed at a distance of 140 cm, a scattering-cutting grid having a grid ratio of 8:1 was placed at the back thereof, and, at the back thereof, a composite of light-sensitive material and fluorescent screens was placed for radiographing. The X-ray exposure was adjusted by changing exposure time to obtain the maximum density of 1.8±0.5 in a lung image. Finished chest radiographs were evaluated for graininess and sharpness according to the following criteria. The results are shown in Tables 4 and 5.

Evaluation Criteria of Graininess

A: Graininess is not noticeable.

B: Graininess is slightly noticeable.

C: Graininess is noticeable and a little problematic for diagnosis.

D: Graininess is very noticeable and problematic for diagnosis.

Evaluation Criteria of Sharpness

A: Very sharp

B: sharp but slightly blurred

C: blurred and a little problematic for diagnosis

D: very blurred and difficult to diagnose

TABLE 4

| Screen Set No. | 1 | | | 2 | | | 3 | | | 4 | | |
|---|---|---|---|---|---|---|---|---|---|---|---|---|
| Screen, on A side | Screen 1 | | | Screen 2 | | | Screen 3 | | | Screen 3 | | |
| Screen, on B side | Screen 1 | | | Screen 2 | | | Screen 3 | | | Screen 2 | | |
| Light-sensitive material Sample No. | Sensitivity | Sharpness | Graininess | Sensitivity | Sharpness | Graininess | Sensitivity | Sharpness | Graininess | Sensitivity | Sharpness | Graininess |
| SR-G | 100 | C | B | — | — | — | — | — | — | — | — | — |
| 1 | 33 | B-C | B | 89 | C | A-B | 117 | C-D | A-B | 107 | C-D | A-B |
| 2 | 23 | D | B | 61 | D | A-B | 82 | D | A | 89 | D | A |
| 3 | 30 | C | B | 82 | C-D | A-B | 105 | D | A-B | 98 | C-D | A-B |
| 4 | 30 | C | B | 82 | C-D | A-B | 105 | D | A-B | 100 | D | A-B |
| 5 | 39 | C | B | 105 | C-D | A-B | 159 | D | A-B | 119 | C-D | A-B |
| 6 | 39 | C | B | 105 | C-D | A-B | 159 | D | A-B | 126 | D | A-B |
| 7 | 33 | C | B | 89 | C-D | A-B | 133 | D | A-B | 110 | C-D | A-B |
| 8 | 33 | C | B | 89 | C-D | A-B | 133 | D | A-B | 110 | D | A-B |
| 9 | 43 | C | B | 115 | C-D | A-B | 173 | D | A-B | 133 | C-D | A-B |
| 10 | 43 | C | B-C | 115 | C-D | B | 173 | D | A-B | 138 | D | A-B |
| 11 | 28 | B-C | B | 75 | C | A-B | 112 | C-D | A | 91 | C-D | A |
| 12 | 28 | B-C | B | 75 | C | A-B | 112 | C-D | A | 91 | D | A |
| 13 | 49 | C | B-C | 131 | C-D | B | 196 | D | A-B | 187 | C-D | B |
| 14 | 49 | C | B-C | 131 | C-D | B | 196 | D | A-B | 175 | C-D | B |
| 15 | 47 | B-C | B | 127 | C | A-B | 189 | C-D | A-B | 161 | C-D | A-B |
| 16 | 47 | B-C | B | 127 | C | A-B | 189 | C-D | A-B | 145 | C-D | A-B |

TABLE 5

| Screen Set No. | 5 | | | 6 | | | 7 | | | |
|---|---|---|---|---|---|---|---|---|---|---|
| Screen, on A side | Screen 2 | | | Screen 1 | | | Screen 1 | | | |
| Screen, on B side | Screen 3 | | | Screen 2 | | | Screen 3 | | | |
| Light-sensitive material Sample No. | Sensi-tivity | Sharp-ness | Grain-iness | Sensi-tivity | Sharp-ness | Grain-iness | Sensi-tivity | Sharp-ness | Grain-iness | Remarks |
| SR-G | — | — | — | — | — | — | — | — | — | The invention is |
| 1 | 107 | B-C | A-B | 61 | B-C | B | 71 | B-C | A-B | a composite of |
| 2 | 88 | D | A | 49 | D | A-B | 58 | D | A-B | Sample No. 3, 5 |
| 3 | 100 | A | A | 56 | C | A-B | 66 | D | A-B | 7 or 9 and set of |
| 4 | 98 | B-C | A-B | 56 | C | B | 63 | C | A-B | screens 5. |
| 5 | 126 | A | A | 75 | C | A-B | 87 | C | A-B | |
| 6 | 119 | B-C | A-B | 71 | C | B | 78 | D | A-B | |
| 7 | 109 | A | A | 61 | C | B | 71 | D | A-B | |
| 8 | 109 | B-C | A-B | 61 | C | B | 71 | C | B | |
| 9 | 137 | A | A | 82 | C | B | 94 | D | A-B | |
| 10 | 133 | B-C | A-B | 80 | C | B-C | 87 | D | B | |
| 11 | 91 | B-C | A | 52 | C | A-B | 58 | C | A-B | |
| 12 | 91 | B-C | A | 52 | C | A-B | 58 | B-C | A-B | |
| 13 | 174 | B-C | A-B | 108 | C | B | 122 | C | A-B | |
| 14 | 184 | B-C | B | 108 | C | C | 127 | C | C | |
| 15 | 144 | B-C | A-B | 85 | C | A-B | 75 | C | A-B | |
| 16 | 160 | B-C | A-B | 91 | B-C | B | 110 | B-C | B | |

EXAMPLE 2

Preparation of Dye Dispersion

Water, surfactant Alkanol XC (produced by Dupont Corporation) and a dye represented by the following chemical Formula were dispersed for 4 days in the presence of zirconium oxide beads by a ball mill method.

Dye

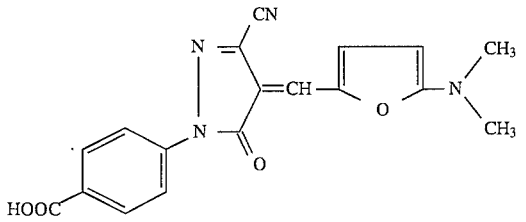

Thereafter, the resulting dispersion was mixed with a gelatin solution for 10 minutes, and filtered to obtain a dye dispersion.

The dye dispersion was coated between the support and the silver halide emulsion layer in each of the light sensitive materials of Example 1 to give a dye content of 25 mg/m$^2$. Thus, Samples 17 through 32 were obtained.

The resulting samples were combined with the screens and evaluated for sensitivity, graininess and sharpness in the same manner as in Example 1. The results are shown in Tables 6 and 7.

TABLE 6

| Screen Set No. | 1 | | | 2 | | | 3 | | | 4 | | |
|---|---|---|---|---|---|---|---|---|---|---|---|---|
| Screen, on A side | Screen 1 | | | Screen 2 | | | Screen 3 | | | Screen 3 | | |
| Screen, on B side | Screen 1 | | | Screen 2 | | | Screen 3 | | | Screen 2 | | |
| Light-sensitive material Sample No. | Sensi-tivity | Sharp-ness | Grain-iness | Sensi-tivity | Sharp-ness | Grain-iness | Sensi-tivity | Sharp-ness | Grain-iness | Sensi-tivity | Sharp-ness | Grain-iness |
| SR-G | 100 | C | B | — | — | — | — | — | — | — | — | — |
| 17 | 28 | B | B | 76 | B-C | A-B | 99 | C | A-B | 91 | C | A-B |
| 18 | 20 | C-D | B | 52 | C-D | A-B | 69 | C-D | A | 75 | C-D | A |
| 19 | 25 | B-C | B | 70 | C | A-B | 89 | C-D | A-B | 83 | C | A-B |
| 20 | 25 | B-C | B | 70 | C | A-B | 89 | C-D | A-B | 85 | C-D | A-B |
| 21 | 33 | B-C | B | 90 | C | A-B | 135 | C-D | A-B | 101 | C | A-B |
| 22 | 33 | B-C | B-C | 90 | C | B | 135 | C-D | A-B | 107 | C-D | A-B |
| 23 | 28 | B-C | B | 76 | C | A-B | 113 | C-D | A-B | 93 | C | A-B |
| 24 | 28 | B-C | B-C | 76 | C | B | 113 | C-D | A-B | 93 | C-D | A-B |
| 25 | 37 | B-C | B-C | 98 | C | B | 147 | C-D | A-B | 113 | C | A-B |
| 26 | 37 | B-C | C | 98 | C | B | 147 | C-D | A-B | 117 | C-D | B |
| 27 | 24 | B | B | 64 | B-C | A-B | 95 | C | A | 77 | C | A |
| 28 | 24 | B | B | 64 | B-C | A-B | 95 | C | A | 77 | C-D | A |
| 29 | 42 | B-C | B-C | 112 | C | B | 167 | C-D | A-B | 157 | C | B-C |

TABLE 6-continued

| Screen Set No. | 1 | | | 2 | | | 3 | | | 4 | | |
|---|---|---|---|---|---|---|---|---|---|---|---|---|
| Screen, on A side | Screen 1 | | | Screen 2 | | | Screen 3 | | | Screen 3 | | |
| Screen, on B side | Screen 1 | | | Screen 2 | | | Screen 3 | | | Screen 2 | | |
| Light-sensitive material Sample No. | Sensitivity | Sharpness | Graininess | Sensitivity | Sharpness | Graininess | Sensitivity | Sharpness | Graininess | Sensitivity | Sharpness | Graininess |
| 30 | 42 | B-C | C | 112 | C | B-C | 167 | C-D | B | 149 | C | B-C |
| 31 | 40 | B | B | 108 | B-C | A-B | 161 | C | A-B | 137 | C | A-B |
| 32 | 40 | B | B | 108 | B-C | A-B | 161 | C | A-B | 123 | C | A-B |

TABLE 7

| Screen Set No. | 5 | | | 6 | | | 7 | | | |
|---|---|---|---|---|---|---|---|---|---|---|
| Screen, on A side | Screen 2 | | | Screen 1 | | | Screen 1 | | | |
| Screen, on B side | Screen 3 | | | Screen 2 | | | Screen 3 | | | |
| Light-sensitive material Sample No. | Sensitivity | Sharpness | Graininess | Sensitivity | Sharpness | Graininess | Sensitivity | Sharpness | Graininess | Remarks |
| SR-G | — | — | — | — | — | — | — | — | — | The invention is a composite of Sample No. 19, 21, 23 or 25 and set of screens 5. |
| 17 | 91 | B | A-B | 52 | B | B-C | 61 | B | A-B | |
| 18 | 75 | C-D | A | 41 | C-D | A-B | 49 | C-D | A-B | |
| 19 | 97 | A | A | 47 | B-C | B | 56 | C-D | A-B | |
| 20 | 83 | B | A-B | 47 | B-C | B-C | 53 | B-C | A-B | |
| 21 | 119 | A | A | 64 | B-C | A-B | 74 | B-C | A-B | |
| 22 | 101 | B | A-B | 61 | B-C | B-C | 67 | C-D | A-B | |
| 23 | 104 | A | A | 52 | B-C | B-C | 61 | C-D | A-B | |
| 24 | 93 | B | A-B | 52 | B-C | B-C | 61 | B-C | B-C | |
| 25 | 137 | A | A | 70 | B-C | B-C | 80 | C-D | A-B | |
| 26 | 113 | B | B | 68 | B-C | C | 74 | C-D | B-C | |
| 27 | 77 | B | A | 44 | B-C | A-B | 49 | B-C | A-B | |
| 28 | 77 | B | A | 44 | B-C | A-B | 49 | B | A-B | |
| 29 | 148 | B | B | 92 | B-C | B-C | 104 | B-C | A-B | |
| 30 | 156 | B | B-C | 92 | B-C | C-D | 108 | B-C | C-D | |
| 31 | 123 | B | A-B | 73 | B-C | B | 64 | B-C | A-B | |
| 32 | 136 | B | A-B | 77 | B | B-C | 93 | B | B-C | |

As is apparent from the above, the composite of the light-sensitive material of the invention and the fluorescent screens of the invention is equal to or higher in sensitivity and excellent in sharpness and graininess, as compared with the conventional composite of a light-sensitive material and fluorescent screens (composite SR-G/fluorescent screen set 1).

EXAMPLE 3

A composite of screen set 5 and each of Samples 1 through 32 in Examples 1 and 2 was photographed using a rectangular wave chart. MTF of the resulting samples was measured using a contrast method. MTF was represented in terms of space frequency 2.0 line/mm. The results are shown in Table 8.

TABLE 8

| Sample No. | MTF (2 LP/mm) | Remarks | Sample No. | MTF (2 LP/mm) | Remarks |
|---|---|---|---|---|---|
| 1 | 0.60 | Comparative | 17 | 0.65 | Comparative |
| 2 | 0.54 | Comparative | 18 | 0.56 | Comparative |
| 3 | 0.70 | Invention | 19 | 0.80 | Invention |
| 4 | 0.62 | Comparative | 20 | 0.67 | Comparative |

TABLE 8-continued

| Sample No. | MTF (2 LP/mm) | Remarks | Sample No. | MTF (2 LP/mm) | Remarks |
|---|---|---|---|---|---|
| 5 | 0.71 | Invention | 21 | 0.81 | Invention |
| 6 | 0.61 | Comparative | 22 | 0.66 | Comparative |
| 7 | 0.70 | Invention | 23 | 0.81 | Invention |
| 8 | 0.60 | Comparative | 24 | 0.65 | Comparative |
| 9 | 0.72 | Invention | 25 | 0.82 | Invention |
| 10 | 0.61 | Comparative | 26 | 0.65 | Comparative |
| 11 | 0.60 | Comparative | 27 | 0.65 | Comparative |
| 12 | 0.62 | Comparative | 28 | 0.67 | Comparative |
| 13 | 0.59 | Comparative | 29 | 0.63 | Comparative |
| 14 | 0.60 | Comparative | 30 | 0.65 | Comparative |
| 15 | 0.61 | Comparative | 31 | 0.66 | Comparative |
| 16 | 0.62 | Comparative | 32 | 0.67 | Comparative |

As is apparent from Table 8, Inventive samples Nos. 3, 5, 7, 9, 19, 21, 23 and 25 are superior to Comparative Samples in MTF, and Sample Nos. 19, 21, 23 and 25 having a dye layer are superior to Nos. 3, 5, 7 and 9 having no dye layer.

What is claimed is:

1. A composite for radiography comprising a) a silver halide photographic light-sensitive material comprising a transparent support and at least one light-sensitive silver halide emulsion layer provided on each side of the support, b) fluorescent screen A having a 80 kVp X-ray energy absorption of 40% or more and c) fluorescent screen B having a 80 kVp X-ray energy absorption of not less than 25% more than fluorescent screen A, the material being sandwiched between the screens A and B in such a manner that emulsion layer A is in close contact with screen A and emulsion layer B is in close contact with screen B, and screen A being positioned on the X-ray radiation source side, wherein the slope of the straight portion in the characteristic curve of emulsion layer A is less than that of emulsion layer B and emulsion layers A and B of the silver halide photographic light-sensitive material have sensitivity on an exposed side that, when the material is exposed to a monochromatic light having the same wavelength as a main emission peak wavelength of the screens and having a half band width of 15±5 nm and developed at 35° C. for 25 seconds with the following developer, an exposure necessary to give a density of the minimum density+0.5 is 0.027 to 0.040 lux·second,

| Developer | |
|---|---|
| Potassium hydroxide | 21 g |
| Potassium sulfite | 63 g |
| Boric acid | 10 g |
| Hydroquinone | 26 g |
| Triethylene glycol | 16 g |
| 5-methylbenzotriazole | 0.06 g |
| 1-phenyl-5-mercaptotetrazole | 0.01 g |
| Glacial acetic acid | 12 g |
| 1-phenyl-3-pyrazolidone | 1.2 g |
| Glutaraldehyde | 5 g |
| Potassium bromide | 4 g |

Water added to 1 liter, and pH adjusted to 10.0.

2. The composite of claim 1, wherein sensitivity of the emulsion layer A is higher than that of the emulsion layer B.

3. The composite of claim 1, wherein a layer reducing a light which emits from one fluorescent screen and arrives at the other emulsion layer of the support opposite the fluorescent screen through the support is provided between the support and the silver halide photographic light-sensitive layer.

4. The composite of claim 3, wherein said light reducing layer contains a dye, said layer being decolored by said developer.

5. The composite of claim 4, wherein said light reducing layer contains said dye in an amount of 5 to 300 mg per $m^2$.

6. The composite of claim 1, wherein the filling rate of a fluorescent substance in the fluorescent screens is not less than 65%.

7. The composite of claim 3, wherein sensitivity of the emulsion layer A is higher than that of the emulsion layer B.

8. The composite of claim 7, wherein the filling rate of a fluorescent substance in the fluorescent screens is not less than 65%.

9. The composite of claim 7 wherein the absorption of fluorescent screen B is not less than 30% more than the absorption of fluorescent screen A.

10. The composite of claim 1 wherein the absorption of fluorescent screen B is not less than 30% more than the absorption of fluorescent screen A.

* * * * *